United States Patent [19]

Oberste-Beulmann

[11] 4,162,810

[45] Jul. 31, 1979

[54] RACK APPARATUS ON A FACE CONVEYOR FOR A MINING MACHINE

[75] Inventor: Klaus Oberste-Beulmann, Sprockhovel, Fed. Rep. of Germany

[73] Assignee: Gebr. Eickhoff, Maschinenfabrik und Eisengiesserei m.b.H., Bochum, Fed. Rep. of Germany

[21] Appl. No.: 918,853

[22] Filed: Jun. 23, 1978

[30] Foreign Application Priority Data

Jun. 29, 1977 [DE] Fed. Rep. of Germany ..... 2729302

[51] Int. Cl.[2] ..... E21C 29/02

[52] U.S. Cl. ..... 299/43

[58] Field of Search ..... 299/32, 34, 42, 43; 104/29

[56] References Cited

U.S. PATENT DOCUMENTS 4,082,361 4/1978 Lanfermann ..... 299/43

FOREIGN PATENT DOCUMENTS 2646291 4/1978 Fed. Rep. of Germany ..... 299/43

*Primary Examiner*—Ernest R. Purser

*Attorney, Agent, or Firm*—Thomas H. Murray; Clifford A. Poff

[57] ABSTRACT

A drive gear of a drum-cutter mining machine engages a rack device extending along the working side of a face conveyor to propel the mining machine along a mine face. Spanning each joint between conveyor tray sections is a bridging rack segment with leg extensions interlocked with recesses formed in extended end members of non-bridging rack segments each of which extends along a single conveyor tray section and is secured thereto by bolts. Rack teeth are formed by spaced-apart pin members carried by lugs outwardly of the face conveyor. The ends of the pin members at the face conveyor for the bridging rack segments are carried by U-shaped plates with a tongue plate engaged behind the extended end members of the non-bridging rack segments. The ends of the pin members at the face conveyor for the non-bridging rack segments are carried by flanges having lower, outwardly-bent sections extending toward the mine floor to form a ramp at the working face side of the face conveyor.

10 Claims, 5 Drawing Figures

RACK APPARATUS ON A FACE CONVEYOR FOR A MINING MACHINE

BACKGROUND OF THE INVENTION

This invention relates to a rack device with longitudinal rack segments joined to each other and bridging the tray joints between sections of a face conveyor, and more particularly to such a rack device wherein the rack portions of the rack segments each has a length corresponding to one-half the length of a tray section for the face conveyor to provide guiding and driving engagement with a drum-cutter mining machine, particularly such a machine having a low overall height for underground mining operations.

As is known in the art, rack pins are provided in racks which are mounted onto the side wall of a face conveyor or onto the side bracket wall. Such racks are used for guiding and advancing a getting machine, more particularly, a drum-cutter mining machine. Such a mining machine engages the rack by means of at least one driving wheel or by means of at least one endless driving chain. The racks of known designs are divided into individual rack segments which bridge the joints between conveyor tray sections or side bracket sections. The length of the rack segments is usually preferably constructed to correspond to one-half the length of the conveyor tray section or a side bracket section. The two ends of the rack segments are joined to the conveyor tray sections or to sections of the side bracket for pivotal movement about horizontal axes. A rack arrangement of this sort is shown in West German Pat. No. 2,520,754.

In U.S. application Ser. No. 882,304, filed Feb. 27, 1978 and assigned to the same Assignee as this invention, there is disclosed a rack for a getting machine, and more particularly a drum-cutter mining machine used for underground mining operations. The rack is made up of rack segments which are joined to each other and mounted onto conveyor tray sections or attached to the side brackets in a manner so that the rack segments are supported and guided for limited longitudinal slidability.

SUMMARY OF THE INVENTION

It is an object of the present invention to provide a rack device extending along a face conveyor for engagement with a drive member of a mining machine wherein the rack device is characterized by a simplified construction to enable longitudinal slidability of rack segments which bridge the joint between conveyor tray sections.

More particularly, the present invention provides the combination of a face conveyor including conveyor tray sections, a drum-cutter mining machine including drive gear means to propel the mining machine along the face conveyor relative to a mine face, and a rack apparatus for guiding and advancing the drum-cutter mining machine along the mine face, the rack apparatus including a plurality of rack members each having rack gear teeth at spaced-apart intervals to mesh with the drive gear means of the mining machine, the plurality of rack members including movable rack segments each bridging a joint between conveyor tray sections, the plurality of rack members further including non-bridging rack segments each supported by an individual one of the conveyor tray sections, the non-bridging rack segments each having extended end members forming interlocking surfaces with surfaces on a movable rack segment to limit slidability thereof to the longitudinal direction of the face conveyor relative to the non-bridging rack segments.

Thus, to achieve the objective of the present invention, the rack apparatus includes longitudinal rack segments, which do not bridge the joints between tray sections, connected by fastener members to the face conveyor and in the region of their ends, such longitudinal rack segments are provided with extensions or with recesses onto which or into which bridging rack segments, which bridge the joints between tray sections, positively act on or engage with corresponding recesses or extensions providing limited slidablity in the longitudinal direction of the face conveyor. A rack apparatus constructed in this manner not only possesses the necessary movability required for shifting movement with the face conveyor but also compensates for pitch errors occurring during the shifting movement of the face conveyor, for example, at the joints between rack segments through the arrangement of longitudinally slidable rack segments which bridge the joints between tray sections. Moreover, a rack apparatus constructed in this manner has a particularly low overall height when the longitudinal rack segments, which do not bridge the joints between conveyor tray sections, are joined to the side wall of the face conveyor only at the flanged ends. In this arrangement, the rack apparatus is particularly suited for arrangement along the working face side of the face conveyor useful as a means for advancing and guiding a drum-cutter mining machine constructed with a low overall height whereby the machine is supported in the region of the rack apparatus and the body of the mining machine extends into the working area at the side of the face conveyor.

A rack apparatus of the present invention enables an arrangement wherein the longitudinal rack segments, which bridge the joints between conveyor tray sections, form connection elements that interconnect the conveyor tray sections of the face conveyor and provide movability corresponding to the clearance at the joint between the conveyor tray sections relative to the two longitudinal rack segments which are mounted on the associated tray sections and enclose the joint between them. This relationship of parts obviates the need for separate connecting elements to join together individual conveyor tray sections of the face conveyor at the side on which the rack apparatus is arranged because the function of the connecting elements is performed by the longitudinal rack segments which bridge the joints between the conveyor tray sections.

In an embodiment of the present invention, there is provided an additional feature through the arrangement wherein the longitudinal rack segments, which do not bridge the joints between the conveyor tray sections, include a flange which projects by an equal amount from the two ends of the rack segment. The projected ends of the flanges of a non-bridging rack segment are situated beneath the plane containing the teeth of the rack. Each projected end is provided with a recess and a portion of the rack, which bridges the joint between the conveyor tray sections, overlies the flanged ends of the non-bridging rack segments for interlocking engagement by means of an extension projecting into each such recess below the teeth of the rack segment. Moreover, the portion of the rack segment, which does not bridge the joint between conveyor tray sections, includes a tongue plate whereby means are provided to grip behind at least one of the flanged ends of the rack segments that do not bridge the joint between conveyor tray sections.

It is particularly convenient to provide according to the present invention that the flange which extends over the entire length of a tray section includes a bottom edge which is bent to extend toward the working face of the mine and extend downwardly toward the mine floor in a manner to form a ramp which slopes toward the floor outwardly of the face conveyor. However, an edge strip may be employed to provide such a ramp by attaching the edge strip to the bottom edge of the flange so that the edge strip projects toward the working face of the mine and forms a ramp to the face conveyor or a machine track along the working face of the conveyor. The rack apparatus functions to provide a means for achieving advancing movement for the drum-cutter mining machine along the working face of the mine and the additional function of providing a sloping ramp at the working face side to push together the debris between the face conveyor and the mine face as the conveyor is moved toward the mine face. The rack apparatus may also function as a machine track to support the drum-cutter mining machine for traversing movement along the mine face.

For rack apparatus, wherein teeth are formed by means of rack pins having axes extending parallel to the mine floor, the present invention provides that the rack apparatus is arranged so that the flange of the rack segments accommodates the ends of the rack pins in the region of the top edge of the flange while it is situated at a distance from the side wall of the face conveyor. The two ends of such rack segments are provided with recesses which are open at the top and into which a portion of a rack segment, which bridges the joint between tray sections, extends vertically and secured by means of laterally-projecting round bars on extended leg portions which engage indentations in the conveyor tray sections.

To improve the angular movability between adjacent conveyor tray sections in the vertical direction, the rack apparatus may be arranged so that the top surface of the flange at each side of the joint between conveyor pan sections has a sloping upper surface to permit an adjustable vertical movement by adjacent portions of an adjoined bridging rack segment.

The rack apparatus is also desirably arranged so that the rack segments terminate with a flush relation along the top edge of the face conveyor to avoid obstruction to the flow of debris from the working face side onto the face conveyor. In such an arrangement, the flange of the rack segments is utilized as a machine track for guiding the drum-cutter mining machine along its course of travel.

These features and advantages of the present invention as well as others will be more fully understood when the following description is read in light of the accompanying drawings, in which.

Figure 1:
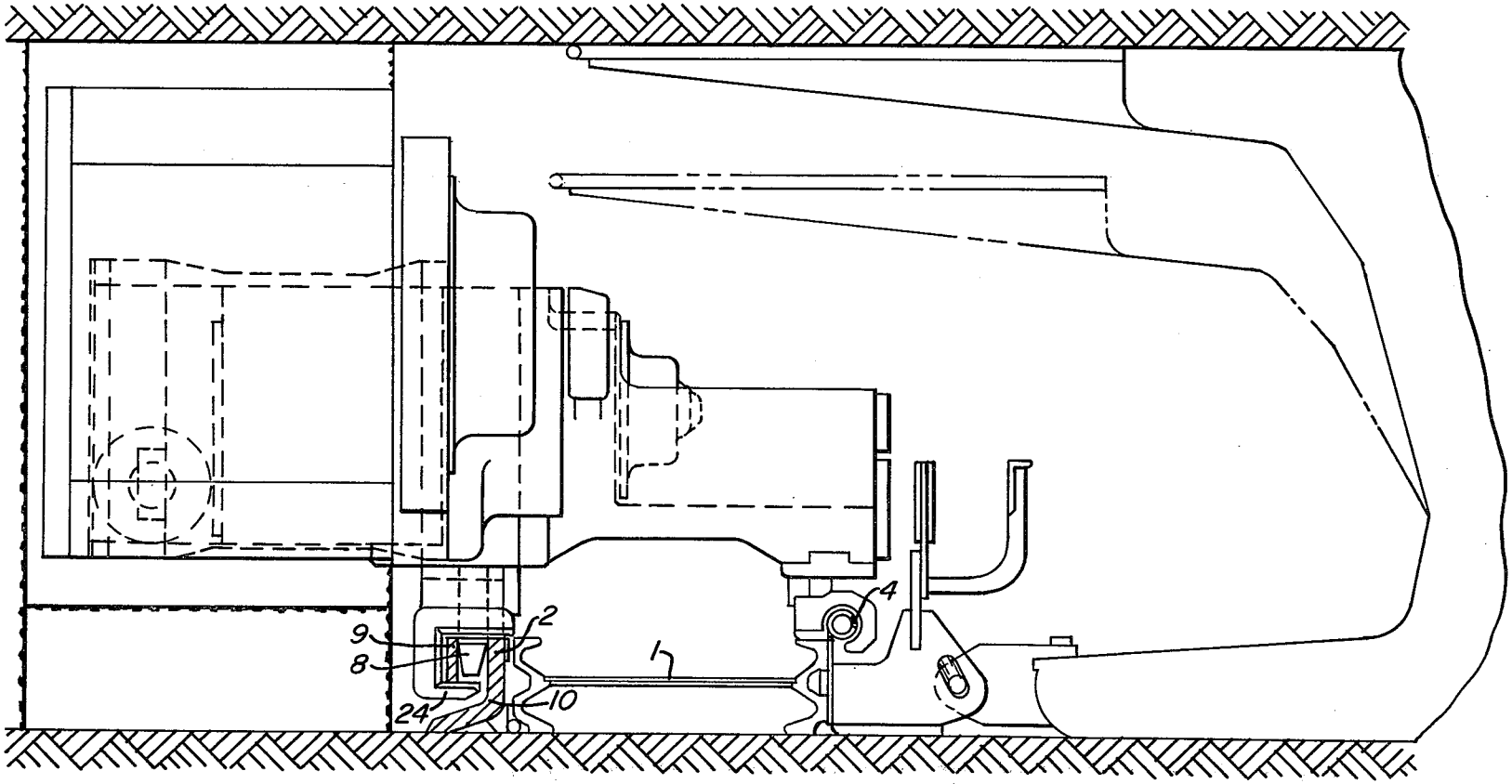
FIG. 1 is an elevational view illustrating, in cross section, a face conveyor extending along a mine face to support a rack apparatus of the present invention for propelling a drum-cutter mining machine.

In FIG. 1, there is illustrated a face conveyor 1 that extends along the working face of a mine at a close but outwardly-spaced relation. As is well known in the art, the face conveyor is made up of individual conveyor tray sections that are joined together end-to-end for limited horizontal pivotal movement therebetween. At the working face side, i.e., the side facing toward the mine face, the side wall of the face conveyor supports a rack apparatus 2 made up of a plurality of rack members arranged in an alternating sequence of movable rack segments 2A, which bridge the joint between conveyor tray sections, and non-bridging rack segments 2B which do not bridge a joint between the conveyor tray sections. According to the embodiments illustrated in FIGS. 1 and 5, the bridging rack segments 2A and non-bridging rack segments 2B are each provided with rack pins 3 that extend parallel to the mine floor. The rack pins are arranged in a spaced-apart relation to form teeth for meshing engagement with a drive wheel 8 of a drum-cutter mining machine 7. At the stowing side, the drum-cutter mining machine is guided by a tubular guide 4 in regard to the embodiment of the invention shown in FIG. 1 and in regard to the embodiment of the invention shown in FIG. 5, guidance is provided by a roller 6 that engages in a guide duct 5 extending along the stowing side. The drum-cutter mining machine bears substantially upon the rack device 2 situated to extend along the working face side of the face conveyor according to the embodiments of FIGS. 1 and 5.

Figure 2:
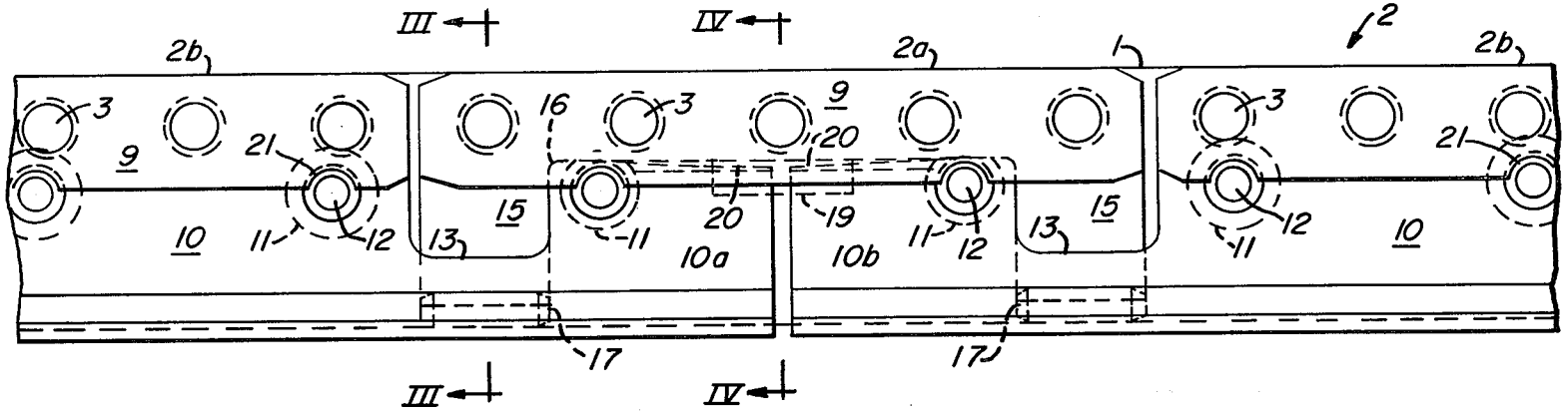
FIG. 2 is an enlarged side view of the rack apparatus shown in FIG. 1.

In both embodiments of the present invention, the non-bridging rack segments 2B each includes, in addition to the rack pins 3, a lug 9 extending over one-half the length of a conveyor tray section and a flange 10 which extends over the entire length of a conveyor tray section. The flange 10 is connected to the side wall of the face conveyor such that flanged ends 10A and 10B projecting from opposite ends of the flange extend beyond the lug 9 and terminate at the end of the conveyor tray section forming a flush relation with the end surface of that tray section which is best shown in FIG. 2. Annular lining members 11 are supported on the surface of flange 10 which faces toward the side wall of the face conveyor. Bores 12 extend through the flange and lining members 11 for receiving mounting bolts, not shown, that extend into supporting engagement with retaining plates 25 secured to the face conveyor. In this way, the non-bridging rack segments are each connected to an individual conveyor tray section of the face conveyor 1. Both of the flanged ends 10A and 10B of each non-bridging rack segment project by the same amount beyond the lug 9. These flanged ends have a height which terminates in a plane beneath the plane of the rack pins 3. A recess 13 is formed in each of the flanged ends 10A and 10b so that the recess extends downwardly into the region of a curved flange portion 14. The bridging rack segments 2A include downwardly-arranged leg extensions 15 that engage into the recesses 13 of the flanged ends 10A and 10B of two adjacent non-bridging rack segments.

The bridging rack segments 2A include, at the working face side of the rack, a side lug 9 which supports the rack pins 3. However, in contrast to the non-bridging rack segments 2B, the bridging rack segments 2A include a U-shaped plate 16 which is connected to and supports the ends of the rack pins 3 at the side nearest the face conveyor 1. The U-shaped configuration of plate 16 forms the downwardly-oriented leg extensions 15 which, as described above, pass into the recesses 13 of the non-bridging rack segments 2B. The height of the web section in plate 16 between the two leg extensions 15 is dimensioned so that the bridging rack segments 2A engage by means of the web section with the flanged ends 10A and 10B of two adjoining non-bridging rack segments 2B. The leg extensions 15 include round bars 17 attached thereto to engage indentations 18 in the conveyor tray sections of the face conveyor 1. In addition to this interlocking relationship, a tongue plate 19 extends from the web section to grip behind the flanges of two adjacent non-bridging rack segments 2B. The flanges 10 are thinner than plate 16 and through the use of the annular lining members 11, the flanges 10 are spaced by a short distance from the side wall of the face conveyor 1. Through this construction and relationship of parts, each bridging rack segment 2A is secured in place along the working face side of the face conveyor. The recesses 13 each has a width which is greater than the width of leg extensions 15 engaged therein, whereby the leg extensions 15 have limited movability in the longitudinal direction of the face conveyor. The bridging rack segments are, therefore, provided with a corresponding amount of sliding motion to compensate for pitch inaccuracies to the spacing between rack pins 3 which occurs at the transition from one segment to the next when the face conveyor is shifted. The flanged ends 10A and 10B include sloping top surfaces 20 to provide that the non-bridging rack segments 2B and, therefore, the conveyor tray sections connected thereto have adequate angular movability in the vertical direction. According to the present invention, the bridging rack segments 2A function not only as rack segments but also as the means forming the connection between conveyor tray sections of the face conveyor and thereby dispense with the need for separate conveyor tray connection elements at the side of the face conveyor on which the rack is disposed. Moreover, the lugs 9 of the rack segments 2A and 2B are provided with semicircular recesses 21 at the bottom edges thereof in the region of bores 12. The recesses 21 insure that mounting bolts can be inserted into the associated bores 12 and thence into the mounting plates 25.

Figure 4:
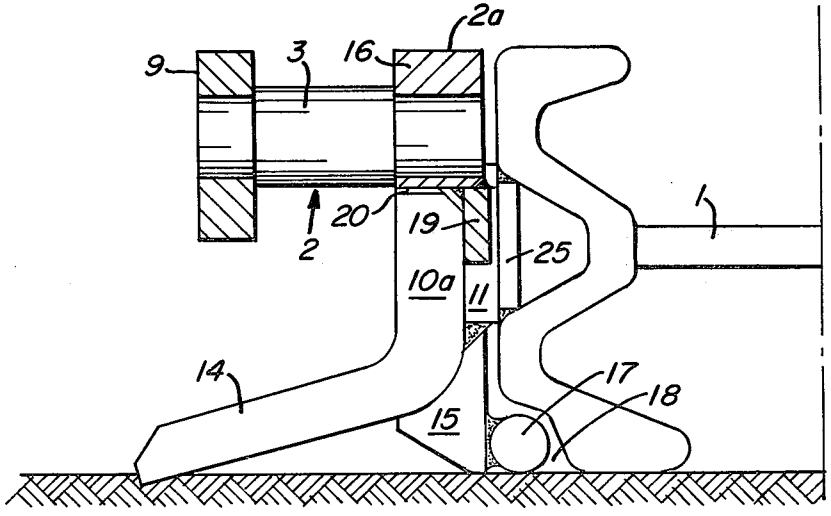
FIG. 4 is an enlarged sectional view taken along line IV—IV of FIG. 2.
Figure 3:
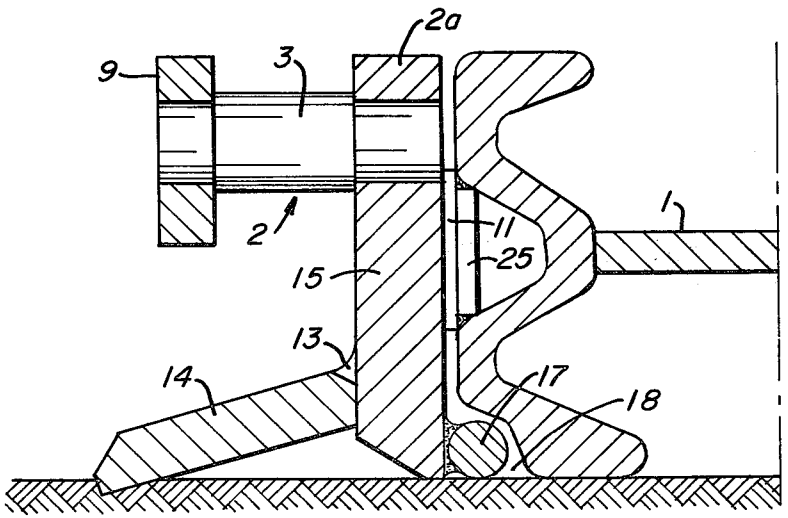
FIG. 3 is an enlarged sectional view taken along line III—III of FIG. 2.
Figure 5:
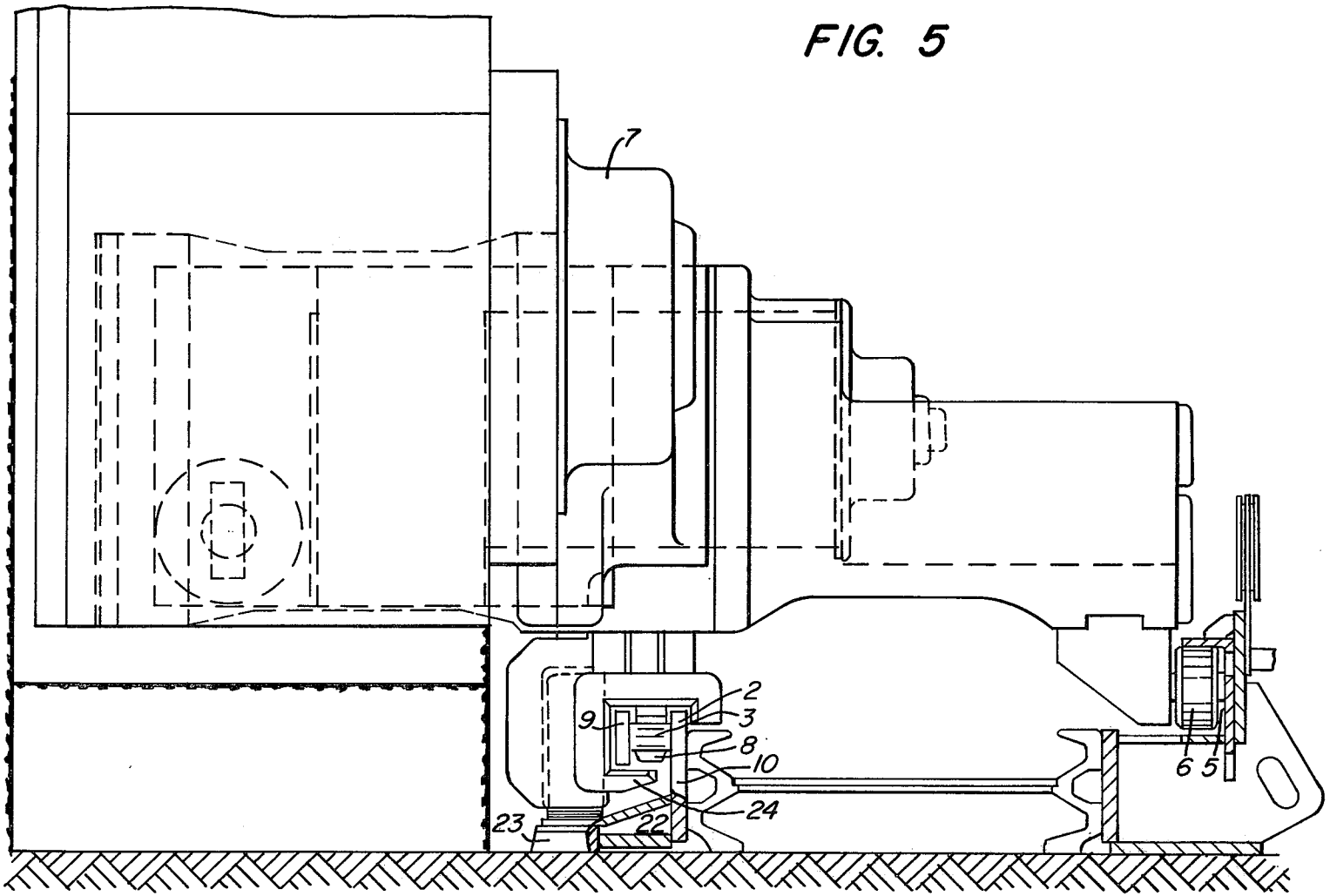
FIG. 5 is a view similar to FIG. 1 but illustrating a second embodiment of rack apparatus according to the present invention.

As best illustrated in FIGS. 3 and 4, the flange 10 of each non-bridging rack segment 2B is dimensioned and curved in a downward direction toward the working face of the mine in a manner to form a ramp configuration. The bottom edge portion 14 of the flange extends to the mine floor outwardly of the face conveyor at the working side thereof to form a sloping ramp. However, in the embodiment of the present invention shown in FIG. 5, the flange 10 is provided along its entire length with an edge strip 22 which projects toward the working face of the mine. The edge strip 22 consists of a box-shaped plate construction to function not only as a sloping ramp but also as a track to support the drum-cutter mining machine. In this regard, FIG. 5 illustrates a machine track 23 situated beneath the rack. The track 23 may be employed to provide a suitable surface for a roller or slide member used to support the drum-cutter mining machine. In FIG. 1, a rolling or sliding type support is provided by the rack to carry the drum-cutter mining machine. In both embodiments of the present invention, additional means 24 are provided to surround the rack and prevent unwanted vertical motion to the drum-cutter mining machine.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In combination, a face conveyor including conveyor tray sections, a drum-cutter mining machine including drive gear means to propel the mining machine along the face conveyor relative to a mine face, and a rack apparatus for guiding and advancing said drum-cutter mining machine along the mine face, said rack apparatus including a plurality of rack members each having rack gear teeth at spaced-apart intervals to mesh with said drive gear means, said plurality of rack members including movable rack segments each bridging a joint between said conveyor tray sections, said plurality of rack members further including non-bridging rack segments each supported by an individual one of said conveyor track sections, the non-bridging rack segments each having extended end members forming interlocking surfaces with surfaces on a movable rack segment to limit slidability thereof in the longitudinal direction of said face conveyor relative to the non-bridging rack segments.

2. The combination according to claim 1 wherein said movable rack segments additionally define interconnection elements joining together said conveyor tray sections with a clearance at each joint between conveyor tray sections corresponding to the movement by the movable rack segments bridging the joint.

3. The combination according to claim 1 wherein each of said non-bridging rack segments includes a flange with projected flange portions extending equal distances beyond the ends of the non-bridging rack segments below rack gear teeth thereof, each projected flange portion having a recess therein, each of said movable rack segments including two spaced-apart leg extensions below the rack gear teeth thereof, each such leg extension engaging in the recess in one of the projected flange portions of a non-bridging rack segment adjacent a common joint between conveyor tray sections.

4. The combination according to claim 1 wherein each of said movable rack segments further includes a tongue plate to engage the back vertical surface of at least one projected flange portion of a non-bridging rack segment adjacent a common joint between conveyor tray sections.

5. The combination according to claim 1 further including a ramp flange extending the entire length of each conveyor tray section, said ramp flange having a bottom edge below the rack gear teeth of said plurality of rack members extending outwardly from the conveyor tray sections toward the floor at the working face of the mine in a manner to form a ramp along the working face side of the face conveyor.

6. The combination according to claim 1 further including a ramp support flange section extending the entire length of each conveyor tray section below the rack gear teeth of said plurality of rack members toward the mine floor, and an edge strip member attached to said ramp support flange section to extend along the mine floor in a manner to form a ramp sloping upwardly from the mine face toward said rack apparatus.

7. The combination according to claim 6 further including a machine track secured to said edge strip member to extend along the mine floor between said rack apparatus and the mine face for supporting said drum-cutter mining machine at the working side of said face conveyor.

8. The combination according to claim 1 wherein said rack gear teeth of the plurality of rack members include rack pins having longitudinal axes extending parallel to the mine floor, and wherein said non-bridging rack segments each further includes a flange spaced from the side wall of the conveyor tray section to support one of the ends of each of said rack pins forming the gear teeth, said non-bridging rack segments having recesses extending to the top surface of each extended end member, said bridging rack segments including extensions to interlock with said recesses of the non-bridging members, and said combination further including round bar members projecting laterally from said extensions on the bridging rack segments, said conveyor tray sections each including an indentation to receive and vertically secure a round bar member on an extension of said bridging rack segment.

9. The combination according to claim 1 wherein said extended end members of said non-bridging rack segments have sloping top surfaces for vertically adjustable movement by an adjacent one of said plurality of rack members.

10. The combination according to claim 1 wherein said rack apparatus extends upwardly into a generally flush relation with the top edge surface of said face conveyor, and wherein said rack apparatus includes means forming a track to support and guide said drum-cutter mining machine.

* * * * *